US006070516A

United States Patent [19]

Esch et al.

[11] Patent Number: 6,070,516

[45] Date of Patent: Jun. 6, 2000

[54] CONTROL FOR THE SCOOP FLAP OF A CONSTRUCTION MACHINE

[75] Inventors: Uwe Esch, Dortmund; Reinhard Siegmund, Waltrop, both of Germany

[73] Assignee: O & K Mining GmbH, Dortmund, Germany

[21] Appl. No.: 08/930,955

[22] PCT Filed: Feb. 28, 1996

[86] PCT No.: PCT/EP96/00803

§ 371 Date: Apr. 2, 1998

§ 102(e) Date: Apr. 2, 1998

[87] PCT Pub. No.: WO96/32547

PCT Pub. Date: Oct. 17, 1996

[30] Foreign Application Priority Data

Apr. 10, 1995 [DE] Germany ..... 195 13 512

[51] Int. Cl.[7] ..... F15B 13/044

[52] U.S. Cl. ..... 91/459; 91/461

[58] Field of Search ..... 91/461, 459; 414/685, 414/699

[56] References Cited

U.S. PATENT DOCUMENTS

| | | | |
|---|---|---|---|
| 3,487,958 | 1/1970 | Shook et al. . | |
| 3,892,079 | 7/1975 | Hirano et al. | 91/459 X |
| 5,220,862 | 6/1993 | Schexnayder | 91/459 X |
| 5,287,699 | 2/1994 | Takamura et al. | 91/459 X |
| 5,490,384 | 2/1996 | Lunzman | 91/459 X |
| 5,784,944 | 7/1998 | Tozawa et al. | 91/459 X |

FOREIGN PATENT DOCUMENTS 0 652 377 5/1995 European Pat. Off. .

*Primary Examiner*—Hoang Nguyen
*Attorney, Agent, or Firm*—Venable; George Spencer; Eric J. Weierstall

[57] ABSTRACT

The proposal is for a control for the scoop flap (1) of a construction machine, especially an excavator, with at least one distributing regulator (9) acting with at least one hydraulic cylinder (4) to which hydraulic control pressure can be applied via at least one electrically actuated valve of at least one control device. When an actuating component (17) is triggered, the control device acting electrically therewith, the valve (10, 11) and via it the distributing regulator (9) and the hydraulic cylinder (4) are actuated according to a predeterminably timed current ramp (22).

16 Claims, 3 Drawing Sheets

CONTROL FOR THE SCOOP FLAP OF A CONSTRUCTION MACHINE

BACKGROUND OF THE INVENTION

The invention relates to a control for the flap of a construction machine, in particular an excavator.

Until recently, only foot pedals were used to actuate the flap, which as a rule is operated with the aid of one or several hydraulic cylinders. One disadvantage that must be mentioned in this connection is that a sensible operation of the hydraulic cylinders and thus also the flap is not always ensured owing to the manual operation of the foot pedal, so that the flap many times comes to rest undamped in its end position. Thus, it lies within the range of experience of the construction machinery operator how long the pedal is activated to avoid undesirable impacts in the end positions of the flap.

SUMMARY OF THE INVENTION

It is the object of the subject-matter of the invention to conceive a control for the scoop, flap of a construction machine, in particular an excavator, through which a simple to operate control diagram is achieved on the one hand and, on the other hand, damages in the region of the hydraulic and/or the flap are avoided with certainty when moving it into the respective stop position.

For the control of the scoop, flap of a construction machine, in particular an excavator, this goal is reached with at least one distributing regulator that operates jointly with at least one hydraulic cylinder connected to the flap and which can be admitted with a hydraulic control pressure via at least one valve that can be electrically operated by at least one control device in that for the actuation of an operating element, the control device acting electrically therewith, the valve and via it the distributing regulator and the hydraulic cylinder are actuated by means of a predeterminably timed current ramp.

Advantageous modifications of the subject-matter of the invention follow from the dependent claims.

Thus, the function of the foot pedal is replaced by a semi-intelligent or intelligent control. At least one push-button switch is provided in the region of the driver's cab, preferably in the region of at least one hand lever provided there, which is electrically connected to a microprocessor (control device). Once the push-button switch is activated, the microprocessor releases a predeterminable, time-dependent current ramp, which electrically acts upon the magnet of at least one relief valve and which subsequently acts hydraulically upon the distributing regulator and thus also the flap cylinder. Since the flap is to be moved in two directions, it is possible to use either two relief valves or a relief valve together with a shuttle valve. This must be reconciled with the respective use. The foot switch can be retained to permit an in-between cleaning of the scoop through an abrupt opening and closing of the flap. This is done in particular when handling materials with a tendency to stick.

If necessary, a push button can be provided at each end position, so that the control detects the end position and a damped operating state can be initiated. All parameters such as time, distance, end position damping or the like can be programmed into the control to bring about a non-problematic actuation of the flap in this way and to avoid unnecessary damages, in particular when moving the scoop flap into the respective end region.

BRIEF DESCRIPTION OF THE DRAWING

The subject-matter of the invention is illustrated with an embodiment in the drawing and is described as follows. In which.

DETAILED DESCRIPTION OF THE INVENTION

Figure 1:
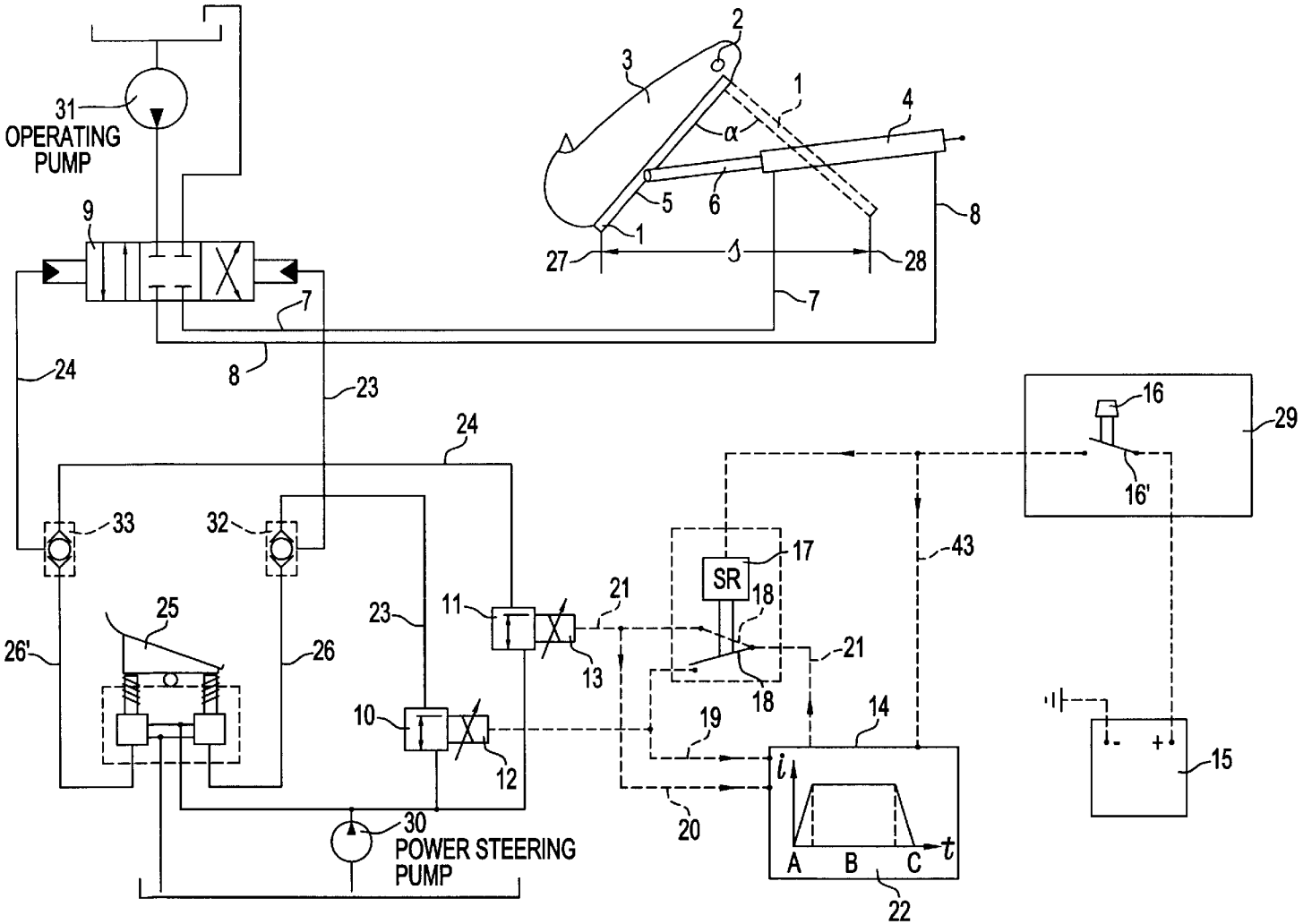
FIG. 1 to 3 illustrate various controls embodiments for actuating the flap of a construction machine according to the invention.

FIG. 1 shows as a basic diagram the control according to the invention for scoop flap 1 in a construction machine not shown in further detail. In a preferred embodiment the construction machine would be an excavator. The flap 1 can pivot flexibly around the articulated point 2 of flap 3, wherein the actuation occurs with the aid of a hydraulic cylinder 4 that is only indicated in the diagram and which is attached in the rear region 5 of the flap 1 via its piston rod 6. The opening or closing distance is indicated with s, while the pivoting angle is provided with the reference sign alpha. By way of the hydraulic lines 7, 8, the hydraulic cylinder 4 operates jointly with a distributing regulator 9, which can be admitted with hydraulic medium via relief valves 10, 11, depending on the movement direction (opening or closing). Each relief valve 10, 11 is provided with a magnet 12, 13, which in turn can be electrically operated by an electronic control device 14 (microprocessor).

The flap 1 is then operated as follows:

A voltage (e.g. 24 V) is generated via a battery 15. When activating a push-button switch 16', which can for example be provided in a hand lever 16 inside a driver's cab 29, the circuit is closed and a signal is transmitted to the electronic control device 14 (arrow direction). A signal is transmitted simultaneously to an impulse relay 17 with changeover contact 18, by means of which the electric signal path for the respective magnet 12 or 13 of the associated valve 10 or 11 is adjusted. The control device 14 is informed via corresponding feedback lines 19, 20 that it is now possible to activate the respective electromagnet 12 or 13. If faulty switching operations occur, a corresponding signal is generated in the driver's cab 29. For this example, the path from the electronic control device 14 via the signal guidance 21 and the changeover contact 18 to the electromagnet 12 is clear if the signal is directed correctly. In this condition, a so-called current ramp 22 is generated through the electronic control device 14, such as is shown in the illustration. The current is drawn in above the time, wherein the current ramp 22 comprises a build-up ramp a, a constant phase b as well as a drop ramp c. The parameters that must be taken into account for generating the current ramp 22 must be adapted to the respective use. In this example, the rise of build-up ramp a is steeper than the drop of drop ramp b [sic], wherein this can of course be carried out differently, depending on the use. Via this current ramp 22, the electromagnet 12 is operated, thereby actuating the relief valve 10, which subsequently releases via the hydraulic line 23 a hydraulic medium proportional to the actuation current for the electromagnet 12. The associated distributing regulator 9 is actuated with the relief valve 10 and, in turn, admits the hydraulic cylinder 4 via the hydraulic line 7, thereby resulting in a corresponding displacement of the flap 1.

Conversely, the electromagnet 13 and thus also the relief valve 11 are actuated via the changeover contact 18, shown with dashed line, wherein the distributing regulator 9 is actuated via the line 24 and the hydraulic cylinder 4 continues to be actuated via the line 8.

Since it is sometimes necessary to realize an abrupt opening or closing of the flap 1 when handling in particular sticky materials, so that caked-on material can be removed, a manual overdrive of the current ramp 22 is possible by means of a foot switch 25, in that the foot switch 25 can directly affect the line 23 or the line 24 directly, e.g. mechanically hydraulically via the line 26, 26'. The measure according to the invention ensures that the flap 1 does not engage unintentionally and unchecked in the end positions 27 or 28. As a result of this, avoidable damages on the flap 1 as well as 3 and the hydraulic cylinder 4 are prevented. Push buttons that are not shown in detail in this example can be provided for, if necessary, in the region of end positions 27, 28. These, in turn, can be linked to the electronic control device 14 and thus can cause a certain damping behavior when moving it into the respective end region 27 or 28.

In this example, a power-steering pump 30 generates the necessary control pressure of, for example, 40 bar for actuating the distributing regulator 9, while an operating pump 31 provides the respectively high pressure, e.g. 400 bar, for admitting the hydraulic cylinder 4. A corresponding return-flow valve 32, 33 is inserted into the line 23 as well as the line 24 so that the activation of foot pedal 25 does not cause problems during the overdrive of current ramp 22. The reference number 43 indicates the impulse line, also referred to as trigger line, which indicates to the microprocessor 14 that it can generate the time ramp 22 within a prescribed time interval.

Figure 2:
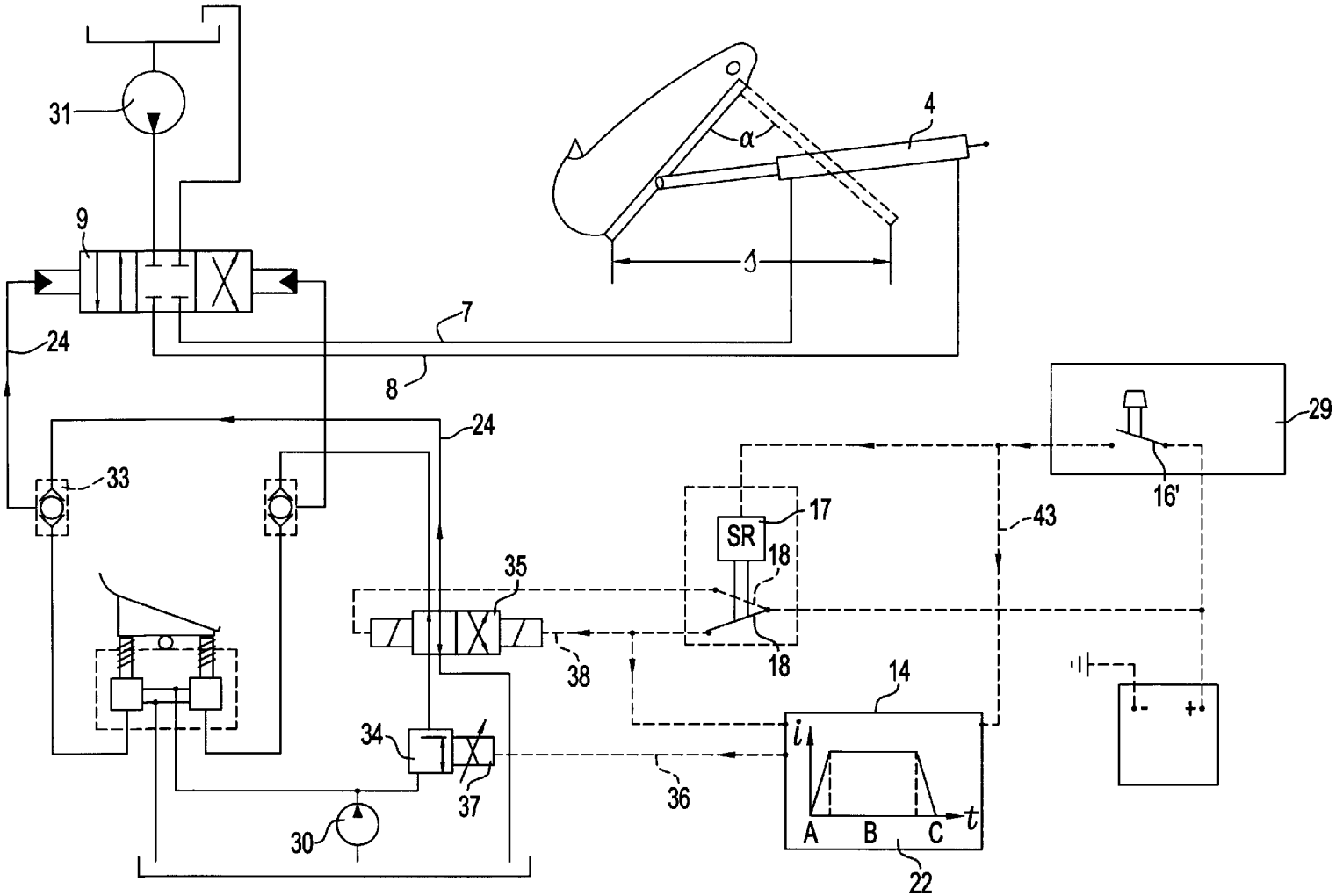

The exemplary embodiment shown in FIG. 2 is designed approximately analog to that in FIG. 1, so that the same reference numbers are assigned to the same structural components. The difference to FIG. 1 is that only one relief valve, namely the relief valve 34, is used in place of the two relief valves and that it operates jointly with a shuttle valve 35. If the current flow is activated via the push-button switch 16'provided inside the driver's cab 29, then an impulse relay 17 with changeover contact 18 is actuated in this case as well and an impulse is transmitted simultaneously via the trigger line 43 to the control device 14, with the instruction to build up the current ramp 22 within a predetermined time interval. The control device 14 is connected via a signalling line 36 with the magnet 37 of the relief valve 34. The control pressure made available via the power-steering pump 30 is made available, proportional to the actuation of magnet 37, to the shuttle valve 35, which has assumed its correct position in the meantime —actuated by the contact closing of changeover contact 18 and the line 38—so that the oil flow reaches the distributing regulator 9 via the line 24. The distributing regulator is moved to a corresponding position by the existing control pressure, so that the high pressure generated by the working pump 31 is transmitted via the line 8 to the cylinder 4. A return-flow valve 33 is provided here as well, analog to FIG. 1.

Figure 3:
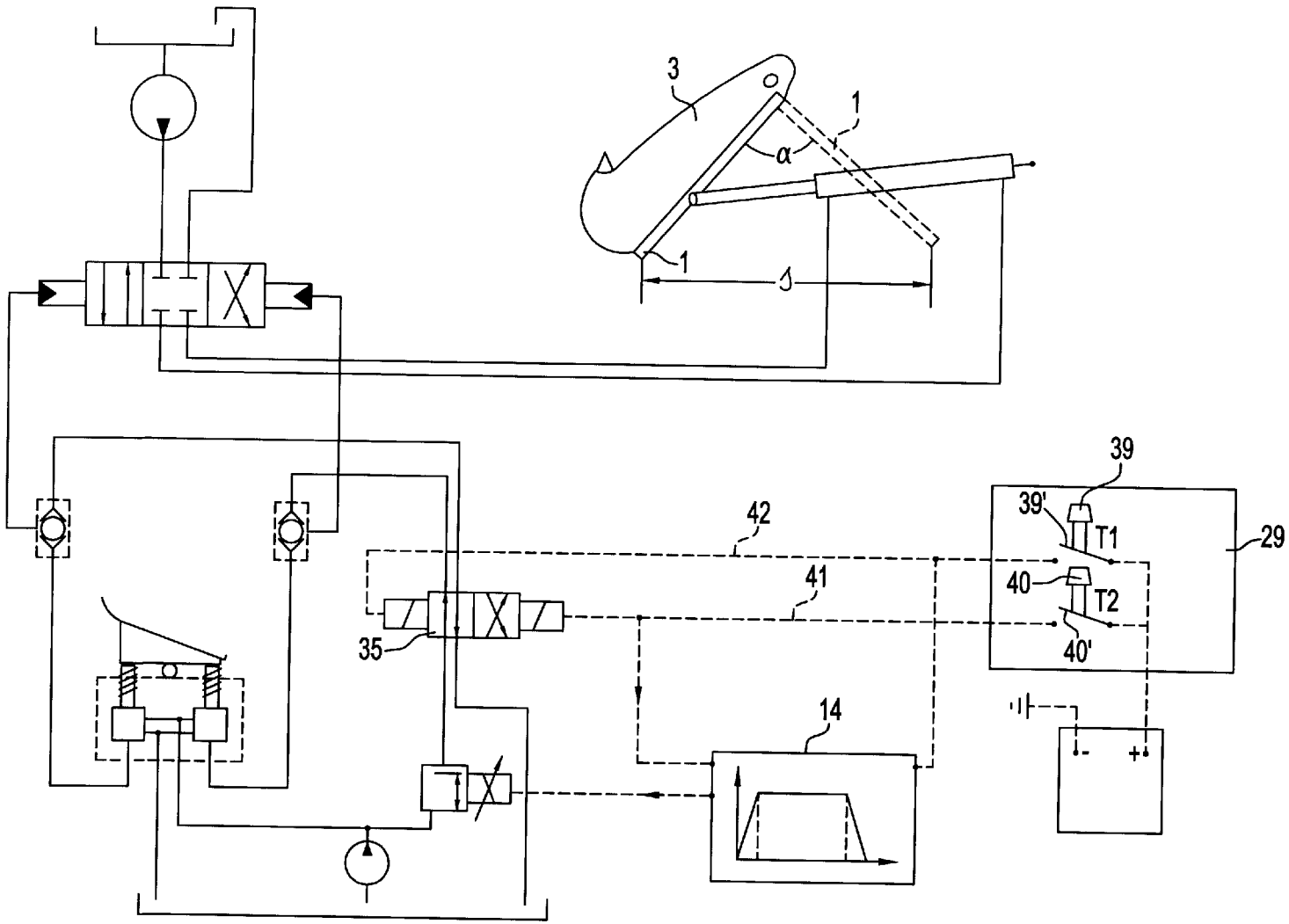

FIG. 3 shows a further alternative for controlling the flap 1 of a scoop with flap 3. Here too, the same structural components are given the same reference numbers. Differing from the FIGS. 1 and 2, two levers 39, 40 with the coordinated push-button switches 39', 40' are provided in the driver's cab 29. The impulse relay as well as the changeover contact according to FIG. 2 can be omitted since these push-button switches 39', 40' are assigned the functions "opening" and "closing" of the flap 1. The signals from push-button switches 39', 40' can on the one hand be provided via the lines 41, 42 to the control device 14 and, on the other hand, to the shuttle valve 35. The further signal course as well as the actuation of the subsequently connected components is the same as in FIG. 2.

We claim:

1. A control system for a flap hinged to a scoop of a construction machine, comprising:

hydraulic cylinder connected to said flap of said scoop;

distributing regulator, connected to and operating jointly with said hydraulic cylinder to regulate hydraulic pressure within said hydraulic cylinder and to position said hydraulic cylinder;

at least one valve connected with said distributing regulator for control of hydraulic fluid;

electrically operated control device for controlling said at least one valve;

at least one operating element connected to said electrically operated control device wherein actuation of said operating element moves said hydraulic cylinder according a predetermined timed current ramp thereby moving said hinged flap a distance relative to said scoop in a predetermined fashion, said movement including closing said flap onto said scoop and opening said flap away from said scoop.

2. The control system of claim 1, wherein the construction machine is an excavator.

3. The control system of claim 1, further comprising two valves which act as relief valves for the opening closing functions of said flap, wherein the opening and closing time for the flap is proportional to distance said flap has moved.

4. The control system of claim 1, wherein one of said at least one valve is actuated via an actuating operating element prior to the build-up of the current ramp by means of at least one actuation element.

5. The control system of claim 4, wherein the actuation element comprises an impulse relay with a changeover contact.

6.The control system of claim 5, wherein the actuation of the impulse relay is signaled to the control device prior to the build up of the current ramp via signaling line.

7. The control system of claim 1, wherein one of said at least one valve includes a relief valve and a shuttle valve operatively, connected to said relief valve in triggering the opening and closing functions of said flap said shuttle valve, being actuated by an impulse relay with changeover contact.

8.The control system of claim 1, further comprising two actuation elements linked directly with said control device via signaling lines, wherein the actuation elements function independently, one element to control the opening and the other element to control the closing functions of the flap.

9. The control system of claim 1, wherein one of said at least one valve is a shuttle valve having two inputs which are connected to a corresponding actuation element for opening the flap or for closing the flap.

10. The control system of claim 1, further comprising a timed current ramp incorporating a signal course for the opening and closing of the flap which is divided into three regions: (a) build-up ramp, (b) constant phase, and (c) drop ramp.

11. The control system of claim 1, wherein identical current ramps are preset in the control device for the control functions of opening the flap and closing the flap.

12. The control system of claim 1, wherein different current ramps are preset in the control device for the control functions of opening the flap and closing the flap.

13. The control system of claim 1, further comprising a manual override foot switch to override the current ramp.

14. The control system of claim 13, wherein the manual override is connected via hydraulic lines to the distributing regulator to manually override the current ramp.

15. The control system of claim 1, further comprising at least one actuating element corresponding to said at least one operating element to actuate the control device wherein the at least one actuating element is a hand lever.

16. The control system of claim 1, further compromising at least one actuating element corresponding to said at least one operating element to actuate the control device wherein the at least one actuating element is a push-button switch.

* * * * *